US005833028A

United States Patent [19]

Ramsey et al.

[11] Patent Number: 5,833,028

[45] Date of Patent: Nov. 10, 1998

[54] ROLLER ATTACHMENT FOR LADDERS

[76] Inventors: Gregory D. Ramsey, 12535 Springfield Rd., New Springfield, Ohio 44443; Jeffrey R. Ramsey, 7627 Hitchcock Rd., Boardman, Ohio 44512

[21] Appl. No.: 984,626

[22] Filed: Dec. 3, 1997

[51] Int. Cl.[6] ..... E06C 7/48

[52] U.S. Cl. ..... 182/129; 182/108

[58] Field of Search ..... 182/129, 107, 182/17, 15, 108; 280/4; 16/45

[56] References Cited

U.S. PATENT DOCUMENTS

| | | | |
|---|---|---|---|
| 524,270 | 8/1894 | Winbush | 182/20 |
| 1,606,198 | 11/1926 | Werk . | |
| 1,701,951 | 2/1929 | Holt | 182/15 |
| 2,000,902 | 5/1935 | Kortz . | |
| 2,597,902 | 5/1952 | Roketa . | |
| 3,446,309 | 5/1969 | Davis | 182/129 |
| 3,773,143 | 11/1973 | Del Prete et al. . | |
| 3,857,460 | 12/1974 | Nini | 182/20 |
| 3,929,208 | 12/1975 | Hendrich | 182/108 |
| 4,394,887 | 7/1983 | Spinks . | |
| 4,754,843 | 7/1988 | Anderson . | |
| 5,123,503 | 6/1992 | Clarke . | |

*Primary Examiner*—Alvin Chin-Shue
*Attorney, Agent, or Firm*—Harpman & Harpman

[57] ABSTRACT

A roller device for ladders which facilitates moving the ladder along a wall vertically to accommodate changes in the ladder's angular inclination thereagainst. The roller device has a pair of sleeves that are removably positioned over the respective top ends of the ladder's rails. Each of the sleeves has an internal rail stop and a wheel rotatably positioned on its respective ends. One of the sleeves has a wheel brake to prevent "roll back" of the ladder once it is positioned against the wall with the attached roller device.

7 Claims, 4 Drawing Sheets

ROLLER ATTACHMENT FOR LADDERS

BACKGROUND OF THE INVENTION

1. Technical Field

This device relates to accessories for ladders of the type that are typically used to position the user in an elevated position on a wall or the like. Such devices provide for vertical movement of the ladder against the wall by using auxiliary wheels attached to the top end of the ladder.

2. Description of Prior Art

Prior art devices of this type have relied on a variety of different designs that position wheels on the top end of a ladder, see for example U.S. Pat. Nos. 1,606,193, 2,597,902, 3,773,143, 4,394,887, 4,754,843 and 5,123,503.

In U.S. Pat. No. 1,606,193 a ladder attachment is disclosed wherein a wheel is mounted in a framed recess within the end portion of the ladder. A slot is formed within the rail to accommodate the wheel and mounting bracket.

U.S. Pat. No. 2,597,902 is directed towards a ladder rest having an outrigger frame that attaches to the ladder's rails and extends at right angles outwardly therefrom. Stabilizing braces extend from the ladder to the outrigger frame which has a pair of oppositely disposed wheels mounted on its respective ends in offset horizontal relation to the ladder.

U.S. Pat. No. 3,773,143 claims a roller attachment for a ladder having rail engaging clamps from which extend a pair of oppositely disposed telescopically extensible rod sections. Wheels are rotatably positioned on the respective rod ends.

U.S. Pat. No. 4,394,887 illustrates a stand off device that has a telescopically extensible stand off bracket that attaches to the top rungs of the ladder. A horizontally adjustable mounting bracket extends from the end of the stand off bracket with wheels on either end thereof.

U.S. Pat. No. 4,754,843 discloses a roller accessory for a ladder in which a bracket extends between the ladder end rails with a roller extending thereacross.

U.S. Pat. No. 5,123,503 is directed to a compressible roller wheel for loadable equipment, such as a ladder. The roller wheel has portions of different compressibility around its circumference so that under increasing load the portion of the rollers against the wall surface flattens out in relation to the non-compressible portions of the wheel adjacent thereto. The roller is mounted on an axle extending through the "stile" which is a hollow end section of the respective rails above the topmost rung of the ladder.

SUMMARY OF THE INVENTION

A pair of roller mounting devices for use on the end rails of ladders. The device of the invention has a mounting sleeve on which a wheel is rotatably positioned. An internal rail stop and rail engagement fasteners position and secure the mounting sleeves on the respective rails of the ladder. One of the mounting sleeves has a releasable wheel brake assembly that engages and restricts directional rotation of the wheel.

DESCRIPTION OF THE PREFERRED EMBODIMENT

Figure 1:
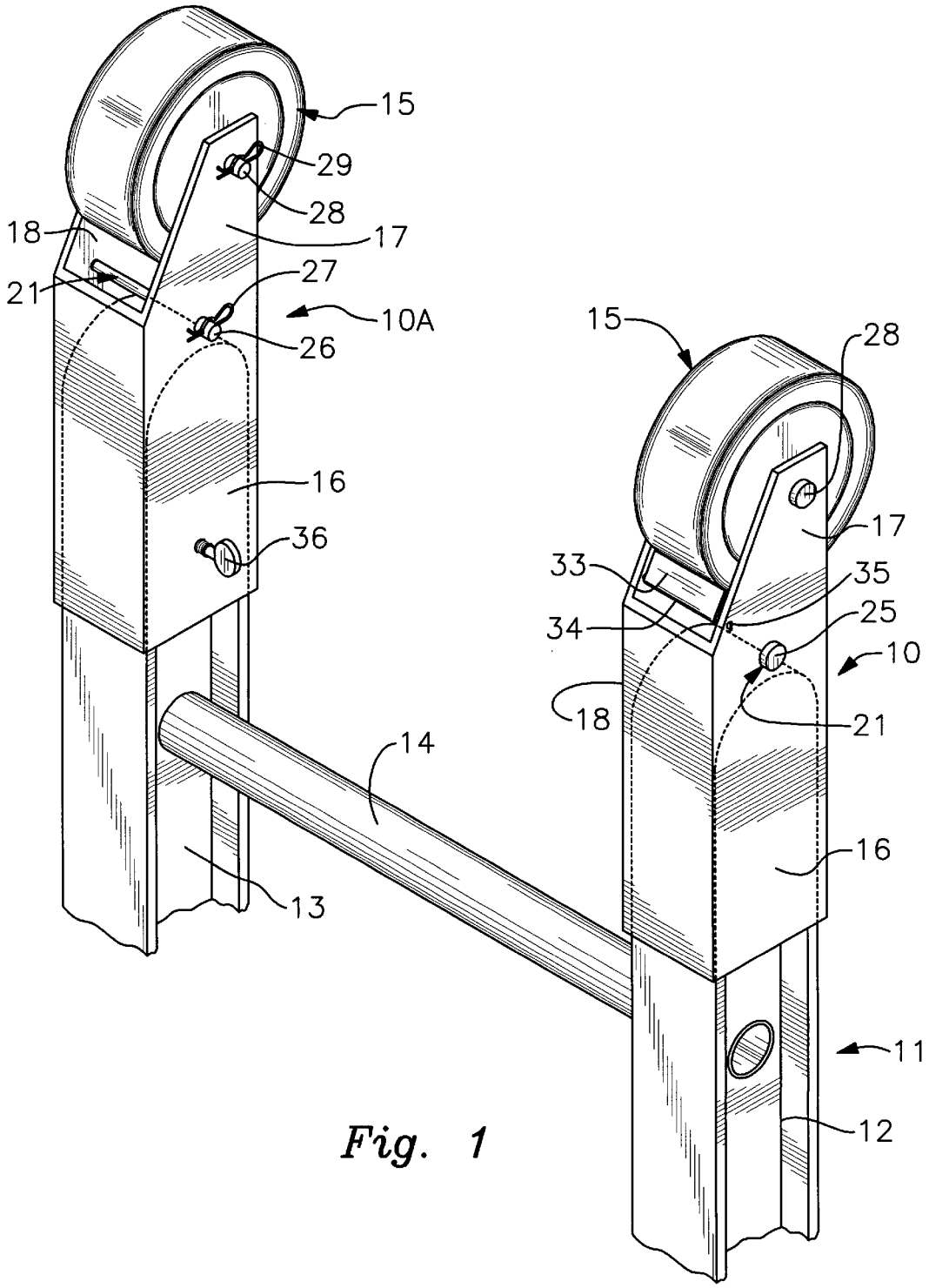
FIG. 1 is a perspective view of a portion of a ladder with the roller device of the invention installed thereon.

Referring now to FIG. 1 of the drawings, a pair of ladder roller devices 10 and 10A can be seen positioned respectively on the ends of a ladder 11. The ladder 11 has a pair of horizontally spaced parallel side rails 12 and 13 with a plurality of rungs 14 extending therebetween and through said respective rails defining a typical ladder as will be well understood by those skilled in the art.

Each of the ladder devices 10 and 10A overlie the free respective end top portions of the rails 12 and 13 extending therebeyond to provide a mounting surface for wheels 15.

Referring now to FIGS. 1, 2, 3 and 4 of the drawings, ladder device 10 can be seen having a main tubular body member 16 with a pair of oppositely disposed parallel flanges 17 and 18 extending therefrom. Each of the flanges 17 and 18 are tapered along their upper surface at 19 and have aligned apertures at adjacent their respective free ends. A rail stop 21 extends through the main body member 16 through aligned apertures therein which are positioned inwardly from a transition point of the main tubular body member 16 and the flanges 17 and 18 as hereinbefore described.

The rail stops 21 are formed from respective pins each having a flange head 25 on one end and an aperture at their respective oppositely disposed ends 26. A resilient retaining pin 27 is inserted through the aperture to secure the pins within the body member 16 as will be well understood by those skilled in the art.

The wheels 15 are rotatably mounted between the hereinbefore disclosed flanges 17 and 18 on respective axle pins 28 that are secured through aligned apertures in the flanges adjacent their respective ends. The axle pins 28 are held in place by resilient retaining pins 29 through apertures therein that is typical within the art.

The wheels 15 have an overall diameter greater than that of the transverse dimension of the main body member 16 and in this example chosen for illustration have a synthetic hub 30 and a resilient rubber perimeter portion 31 thereabout.

Figure 2:
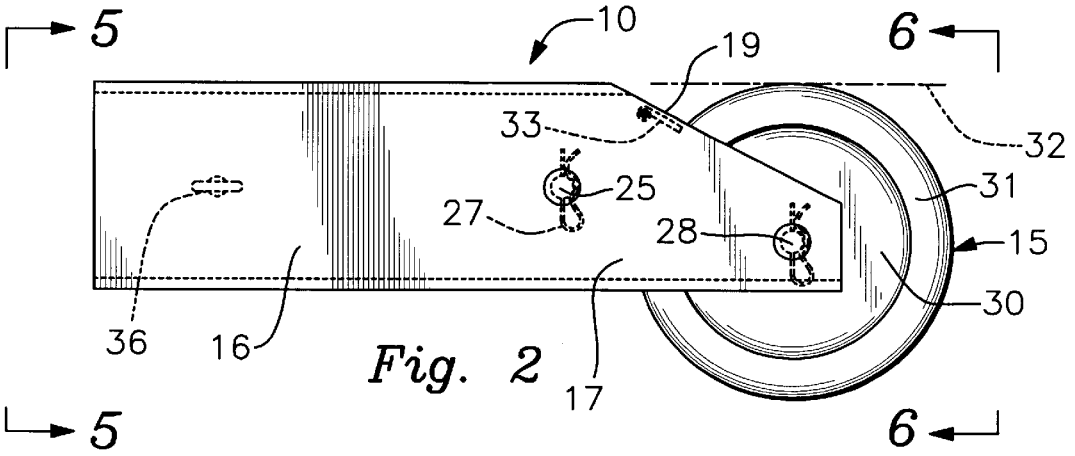
FIG. 2 is a side elevational view of the invention.

It should be noted that due to the mounting position of the wheels 15 on the axle pins 28 within the parallel flanges 17 and 18 and their dimensional characteristics that the wheels do not extend above the upper planar surface 32, shown in broken lines, of the tubular member 16 as seen in FIG. 2 of the drawings.

Figure 3:
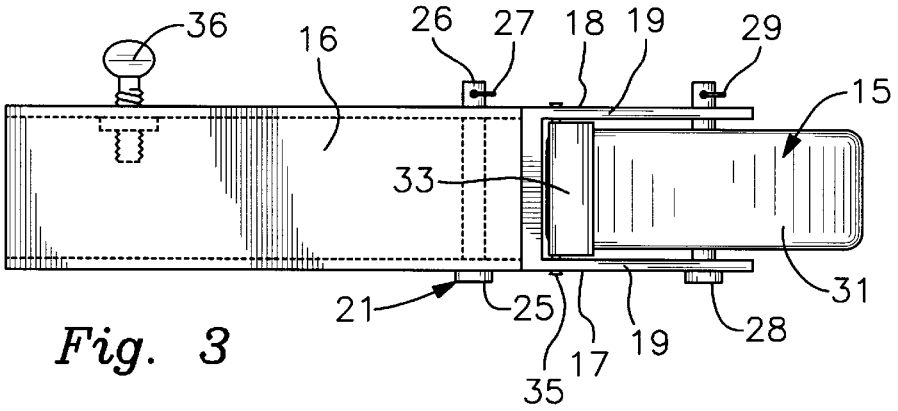
FIG. 3 is a top plan view of the invention set forth in FIG. 2.
Figure 4:
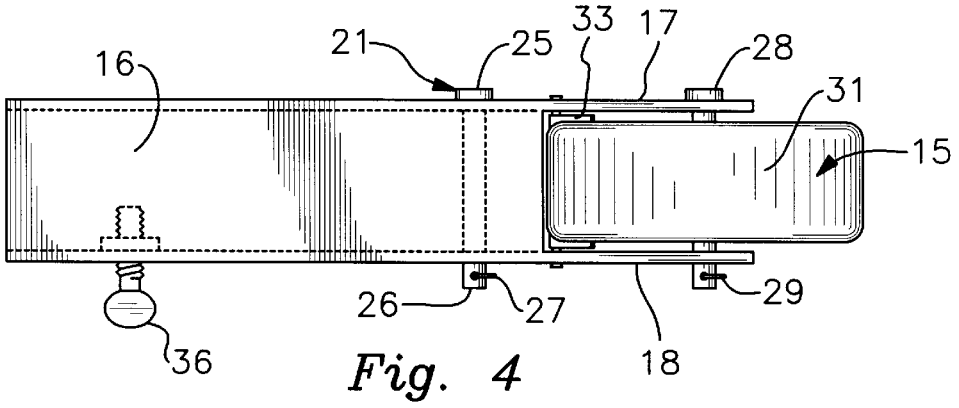
FIG. 4 is a bottom plan view of the invention as seen in FIG. 2.
Figure 6:
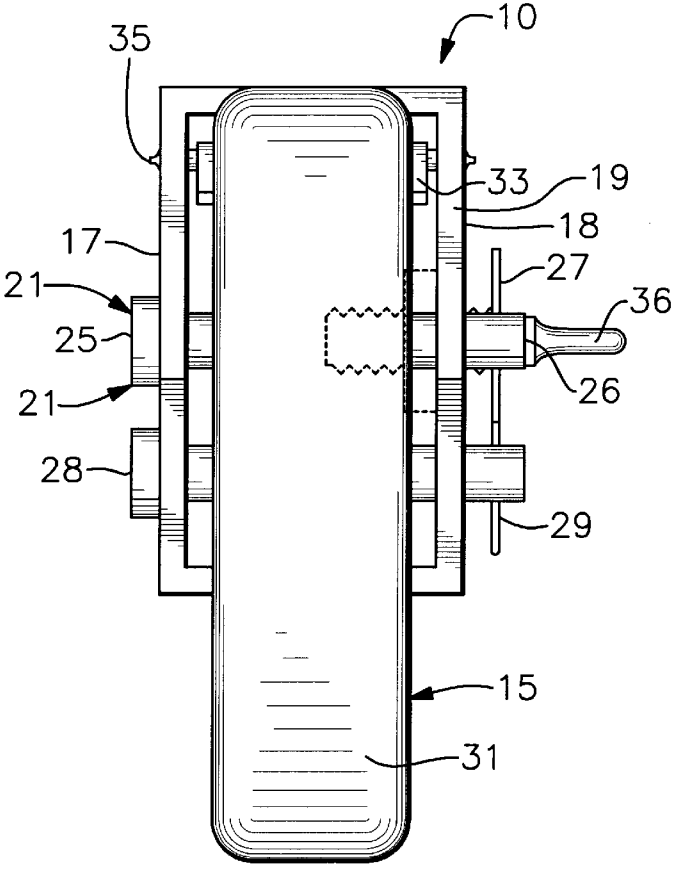
FIG. 6 is an end view on lines 6—6 of FIG. 2.

One of the wheels 15 of the roller device 10 is selectively restricted to one-way rotation on its axle pin 28 by a wheel stop 33 as best seen in FIGS. 2, 3, and 6 of the drawings. The wheel stop 33 is formed of a generally flat rectangular gate with a curved mounting elongated flange 34 along one edge through which a pivot pin 35 is positioned. The wheel stop 33 is mounted between the respective flanges 17 and 18 adjacent the hereinbefore described transition point between the tubular body member 16 and the flanges 17 and 18 by the pivot pin 35 extending therethrough.

The wheel stop 33 is movable from a wheel engagement position shown in FIG. 6 of the drawings to a non-engagement position at 33A illustrated in broken lines.

Figure 5:
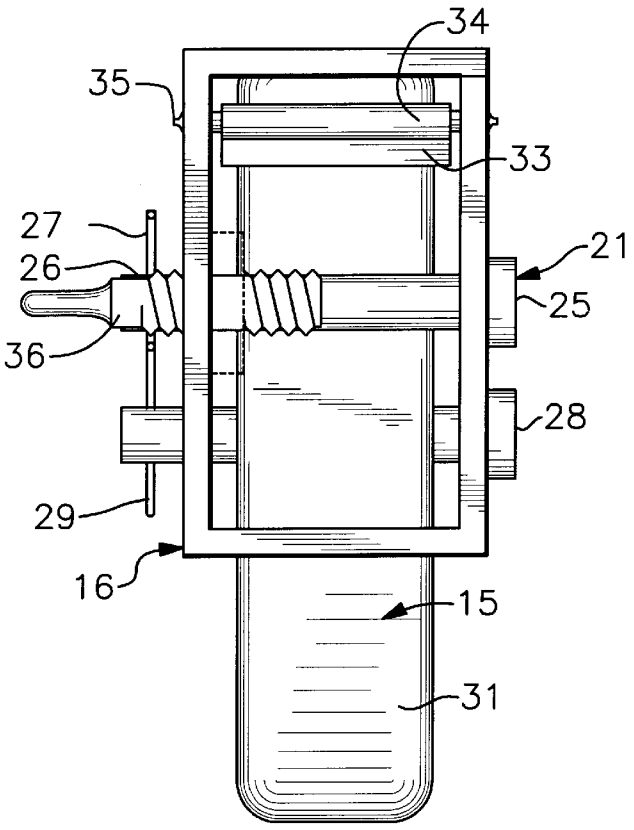
FIG. 5 is an end view on lines 5—5 of FIG. 2.

Referring now to FIGS. 1, 5 and 6 of the drawings, thumb screws 36 are threadably positioned through said respective side 17 of ladder roller 10 and side 18 of ladder roller 10A so as to be advanced therethrough for engagement with said respective ladder rails 12 and 13 selectively locking the ladder rollers 10 and 10A of the invention thereto.

It will be evident from the above description that the roller devices 10 and 10A are identical except for the inclusion of the wheel stop 33 on the roller device 10 and that of the thumb screws 36 which are positioned on oppositely disposed respective sides of the roller devices 10 and 10A as hereinbefore described.

Figure 7:
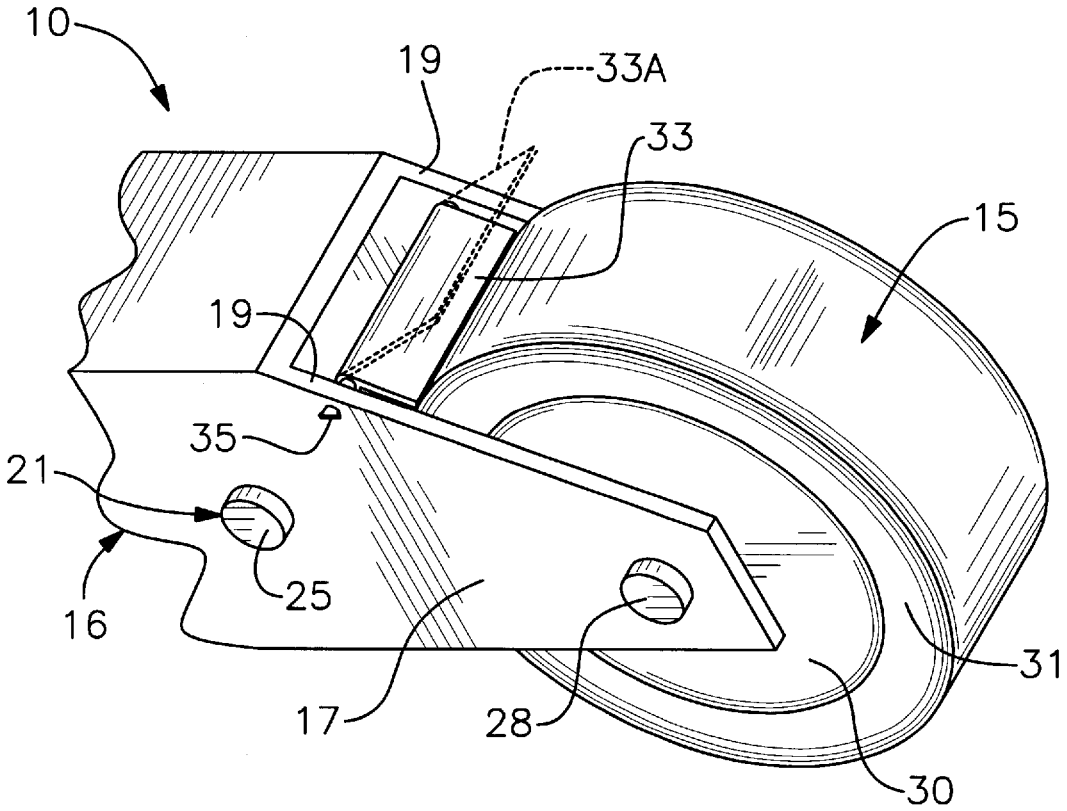
FIG. 7 is an enlarged partial perspective view of the invention.

In operation, the respective roller devices 10 and 10A are positioned on their representative ladder rails 12 and 13 as illustrated in FIG. 1 of the drawings so that the portion of the wheels 15 that extend beyond the mounting flanges 17 and 18 are both facing the same direction which would be towards the structure, not shown, on which the ladder is to be engaged. The roller device 10 having the wheel stop 33 prevents the ladder 11 (with the attached ladder devices 10 and 10A secured thereto by the respective thumb screws 36 to a singular rotation direction illustrated by the arrow in FIG. 1 of the drawings preventing the ladder) from inadvertently moving in the opposite direction unless it is pulled away from the structure, not shown, and the wheel brake 33 is deliberately disengaged by the user by positioning same in an angular inclination as would be evident to one skilled in the art and illustrated by the broken lines of FIG. 7.

It will therefore be seen that a new and useful roller device for ladders has been illustrated and described and it will be apparent to those skilled in the art that various changes and modifications may be made thereto without departing from the spirit of the invention, therefore

We claim:

1. Roller devices for ladders that are removably positioned over the top of rail end portions respectively of the ladder to allow the ladder to be moved over a vertical support surface, said roller devices comprises; a main cross-sectionally rectangular tubular body member having oppositely disposed open ends, parallel flanges extending from one of said open ends of said tubular body members, wheel means rotatably supported between said flanges, a rail stop comprises; a pin extending through aligned oppositely disposed apertures in said tubular body member adjacent said flanges, a brake assembly engageable on one of said wheel means, said brake assembly comprising a plate pivotally secured between said flanges, a selectively engageable fastener means in said tubular body member and resilient movable retaining means for said rail stop and wheel means.

2. The roller devices for ladders set forth in claim 1 wherein said wheel means comprise; an axle pin, a wheel rotatably positioned on said axle.

3. The roller devices for ladders set forth in claim 1 wherein said plate of said wheel brake assembly between flanges extending from one of said tubular body members is movable from a first position engaging said wheel means, to a second position in spaced relation to said wheel means.

4. The roller devices for ladders set forth in claim 1 wherein said selective engageable fastener means in said tubular body member comprises; a threaded thumb screw, said thumb screw threadably positioned in threaded aperture fittings in said tubular body members in oppositely disposed relation to said wheel means.

5. The roller devices for ladders set forth in claim 1 wherein said resilient removable retaining means for rail stops and said wheel means comprises; contoured resilient retaining pins extending through apertures in said rail stop pin and said wheel means.

6. The roller devices for ladders set forth in claim 1 wherein said tubular body members and said flanges are integral and are formed from metal.

7. The roller devices for ladders set forth in claim 1 wherein said parallel flanges are tapered along one of their said edges.

* * * * *